US008059065B2

(12) United States Patent
Kim et al.

(10) Patent No.: US 8,059,065 B2
(45) Date of Patent: Nov. 15, 2011

(54) METHOD AND APPARATUS FOR DRIVING ELECTRO-LUMINESCENCE DISPLAY PANEL

(75) Inventors: Hyun Joung Kim, Daegu (KR); Guen Bae Park, Gyeongsangnam-do (KR); Won Kyu Ha, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 608 days.

(21) Appl. No.: 11/056,188

(22) Filed: Feb. 14, 2005

(65) Prior Publication Data

US 2005/0184934 A1 Aug. 25, 2005

(30) Foreign Application Priority Data

Feb. 20, 2004 (KR) ..... 10-2004-0011588

(51) Int. Cl.
*G09G 3/30* (2006.01)

(52) U.S. Cl. ..... 345/76; 345/82

(58) Field of Classification Search ..... 345/76, 345/82, 77; 315/169.3
See application file for complete search history.

(56) References Cited

U.S. PATENT DOCUMENTS 5,510,805 A * 4/1996 Lee ..... 345/58
7,126,568 B2 * 10/2006 LeChevalier ..... 345/84
7,348,942 B2 * 3/2008 Jo ..... 345/76
2002/0014851 A1 * 2/2002 Tai et al. ..... 315/169.3
2002/0050962 A1 * 5/2002 Kasai ..... 345/76
2002/0140642 A1 * 10/2002 Okamoto ..... 345/76
2002/0186212 A1 * 12/2002 Matsumoto et al. ..... 345/204
2003/0030607 A1 * 2/2003 Kitagawa et al. ..... 345/87
2003/0132899 A1 * 7/2003 Yamaguchi et al. ..... 345/76

OTHER PUBLICATIONS

The D Latch and D Flip Flop [online], Dec. 24, 2002, [retrieved on Oct. 9, 2007]. Retrieved from the internet: <URL http://web.cs.mun.ca/~paul/cs3724/material/web/notes/node13.html>.*

* cited by examiner

*Primary Examiner* — Yong H Sim
(74) *Attorney, Agent, or Firm* — Birch, Stewart, Kolasch & Birch, LLP

(57) ABSTRACT

A method and apparatus for driving an electro-luminescence display panel capable of preventing an initial blinking phenomenon occurring at a power application is disclosed. In the method, a first electrode of the EL cell and a ground voltage source are opened during a first period from a turn-on time of a power source to shut off a current path of the EL cells. Then, the first electrode of the pixel matrix and the ground voltage source is shorted during a second period to form a current path such that the EL cells are light-emitted in accordance with a data supplied to the pixel matrix.

7 Claims, 4 Drawing Sheets

METHOD AND APPARATUS FOR DRIVING ELECTRO-LUMINESCENCE DISPLAY PANEL

This application claims the benefit of Korean Patent Application No. P2004-11588 filed in Korea on Feb. 20, 2004, which is hereby incorporated by reference.

BACKGROUND OF THE INVENTION

1. Field of the Invention

This invention relates to an electro-luminescence display (ELD), and more particularly to a method and apparatus for driving an electro-luminescence display panel that is capable of preventing an initial blinking phenomenon occurring at a power application.

2. Description of the Related Art

Recently, there have been highlighted various flat panel display devices reduced in weight and bulk that is capable of eliminating disadvantages of a cathode ray tube (CRT). Such flat panel display devices include a liquid crystal display (LCD), a field emission display (FED), a plasma display panel (PDP) and an electro-luminescence (EL) display panel, etc.

The EL display panel of these display devices is a self-luminous device capable of light-emitting a phosphorous material by a re-combination of electrons with holes. The EL display panel is largely classified into an inorganic EL device using an inorganic compound as the phosphorous material and an organic EL device using an organic compound as it. Since such an EL display panel has many advantages of a low-voltage driving, a self-luminescence, a thin film type, a wide viewing angle, a fast response speed, and a high contrast, etc., it has been expected as a post-generation display device.

Generally, the organic EL device is comprised of an electron injection layer, an electron carrier layer, a light-emitting layer, a hole carrier layer and a hole injection layer that are sequentially disposed between a cathode and an anode. In such an organic EL device, if a desired voltage is applied between the cathode and the anode, electrons generated from the cathode are moved, via the electron injection layer and the electron carrier layer, into the light-emitting layer while holes generated from the anode are moved, via the hole injection layer and the hole carrier layer, into the light-emitting layer. Thus, the light-emitting layer emits a light by a re-combination of electrons and holes fed from the electron carrier layer and the hole carrier layer, respectively.

As shown in FIG. 1, an active matrix type EL display panel employing such an organic EL device includes a pixel matrix 20 having sub-pixels 28 arranged at each area defined by each intersection between gate lines GL and data lines DL, a gate driver 22 for driving the gate lines GL of the pixel matrix 20, a data driver 24 for driving the data lines DL of the pixel matrix 20, and a power supply 32 and a ground voltage source GND connected to the pixel matrix 20.

The gate driver 22 applies scanning pulses to sequentially drive the gate lines GL.

The data driver 24 supplies R, G and B data signals to each data line DL whenever the scanning pulse is applied. At this time, the data driver 24 converts digital data inputted from the exterior thereof into analog data signals. For instance, the data driver 24 voltage-divides a gamma reference voltage inputted from the exterior thereof into a plurality of gamma voltage levels, and selects the gamma voltage level corresponding to the input digital data to apply it as an analog data signal.

One pixel is implemented by a combination of the R, G and B sub-pixels 28. If the scanning pulse is applied to the gate line GL, then each of the R, G and B sub-pixels 28 receive a data signal from the data line DL to generate a light corresponding to the data signal. To this end, as shown in FIG. 2, each of the R, G and B sub-pixels 28 includes an EL cell OEL having a cathode connected to the ground voltage source GND, and a cell driver 30 connected to the gate line GL and the data line DL to control a current amount fed to an anode of the EL cell OEL from a power line PL, thereby driving the EL cell OEL.

The cell driver 30 includes a switching thin film transistor T1 having a gate terminal connected to the gate line GL, a source terminal connected to the data line DL and a drain terminal connected to a node N1, a driving thin film transistor T2 having a gate terminal connected to the node N1, a source terminal connected to the power line PL and a drain terminal connected to the EL cell OEL, and a storage capacitor C connected between the power line PL and the node N1.

If the scanning pulse is applied to the gate line GL, then the switching thin film transistor T1 is turned on to thereby apply a data signal supplied to the data line DL, via the node N1, to the gate terminal of the driving thin film transistor T2. At this time, the storage capacitor C charges a difference voltage between a driving voltage VDD supplied via the power line PL and the data signal supplied to the node N1. The driving thin film transistor T2 controls a current amount I fed from the power line PL to the EL cell OEL in response to a voltage supplied to the node N1, thereby controlling a light-emitting amount of the EL cell OEL. Further, when the switching thin film transistor T1 is turned off, the driving thin film transistor T2 supplies a constant current I until a data signal at the next frame is applied by a voltage charged in the storage capacitor C, thereby keeping a light-emission of the EL cell OEL.

In the conventional EL display panel having the above-mentioned configuration, as the power supply 32 is turned on, an initial driving voltage VDD is supplied to the pixel matrix 20 prior to an application of the data signal from the data driver 24. For this reason, since the EL cells OEL forms a current path by the initial driving voltage VDD suddenly supplied to the pixel matrix 20, there is raised a problem in that an initial blinking phenomenon occurs.

SUMMARY OF THE INVENTION

Accordingly, it is an object of the present invention to provide a method and apparatus for driving an electro-luminescence display panel that is capable of preventing an initial blinking phenomenon occurring at a power application.

In order to achieve these and other objects of the invention, a method of driving an electro-luminescence display panel, having a plurality of electro-luminescence (EL) cells, according to one aspect of the present invention includes the steps of opening a first electrode of the EL cell and a ground voltage source during a first period from a turn-on time of a power source to shut off a current path of the EL cells; and shorting the first electrode of the pixel matrix and the ground voltage source during a second period to form a current path such that the EL cells are light-emitted in accordance with a data supplied to the pixel matrix.

In the method, said first period includes a time interval from a turn-on time of the power source until an ending time of at least first frame.

The method further includes the step of detecting said first period by utilizing a vertical synchronizing signal for dividing said data for each frame.

A driving apparatus for an electro-luminescence display panel according to another aspect of the present invention includes a pixel matrix having a plurality of sub-pixel each including an EL cell and a cell driver for controlling a current supplied to the EL cell in accordance with a data; a ground voltage source connected to a cathode of the EL cell; a power source connected to the power source line; and a ground voltage source controller for opening the cathode and the ground voltage source during a first period from a turn-on time of the power source to shut off a current path of the EL cells, and for shorting them during a second period to light-emit the EL cells in accordance with a supplied data.

In the driving apparatus, the ground voltage source controller detects said first period by utilizing a vertical synchronizing signal for dividing said data for each frame.

In the driving apparatus, the ground voltage source controller includes a switching device for switching a connection between the cathode of the EL cell and the ground voltage source; and a latch for controlling the switching device using said vertical synchronizing signal.

Herein, the latch opens the switching device from a turn-on time of the power source until an ending time of at least first frame and thereafter shorts the switching device.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 3 and 4.

Figure 1:
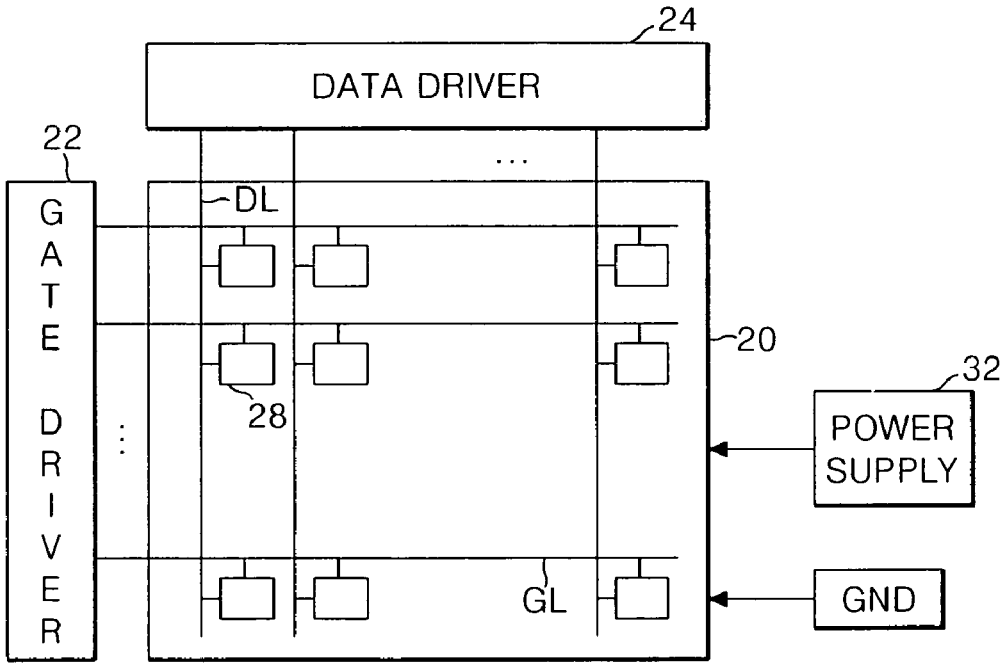
FIG. 1 RELATED ART
FIG. 1 is a schematic block circuit diagram showing a configuration of a conventional organic electro-luminescence display panel.
Figure 2:
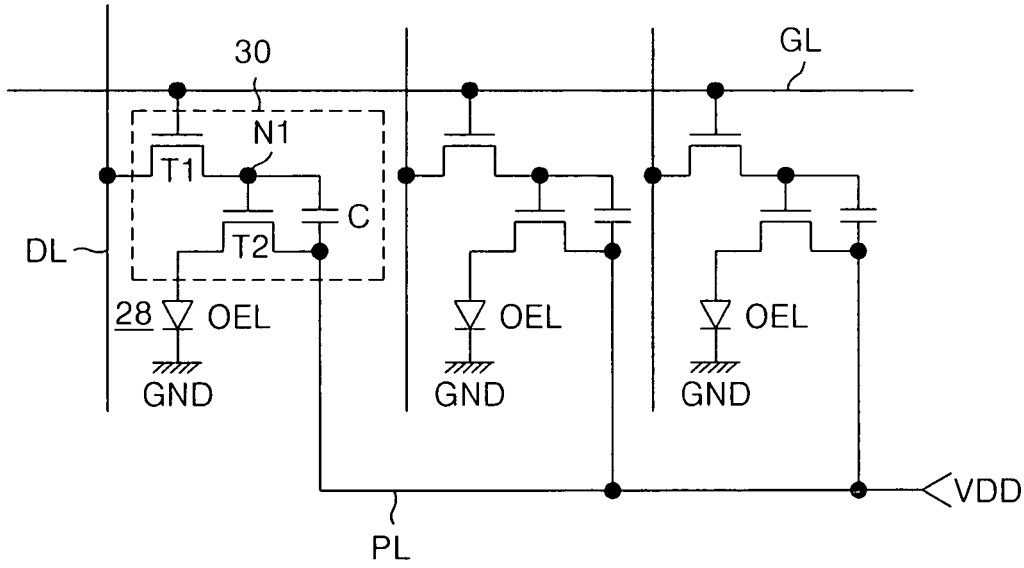
FIG. 2 RELATED ART
FIG. 2 is an equivalent circuit diagram of the sub-pixels shown in FIG. 1.
Figure 3:
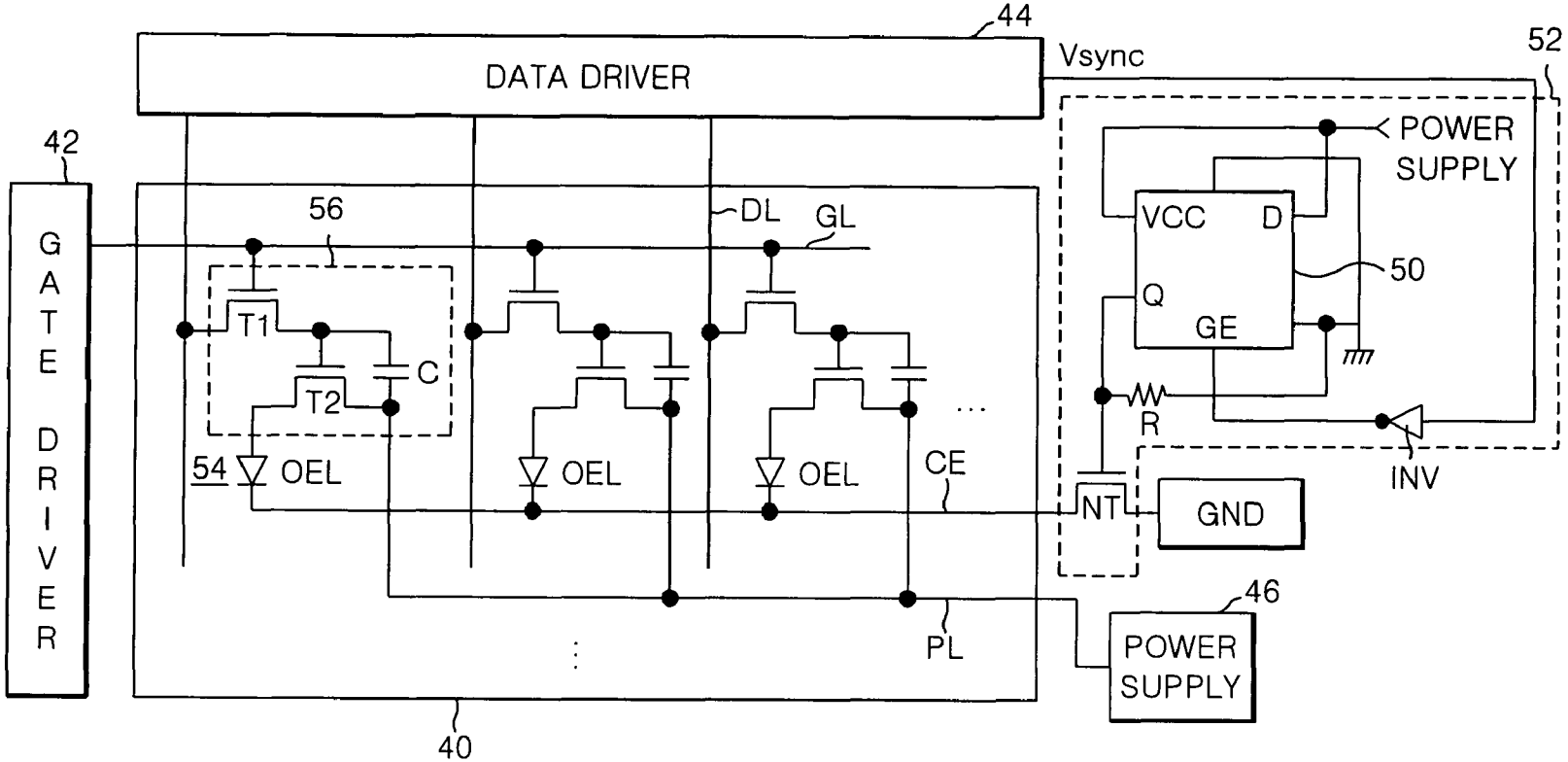
FIG. 3 is a block circuit diagram showing a configuration of a driving apparatus for an organic electro-luminescence display panel according to an embodiment of the present invention.
Figure 4:
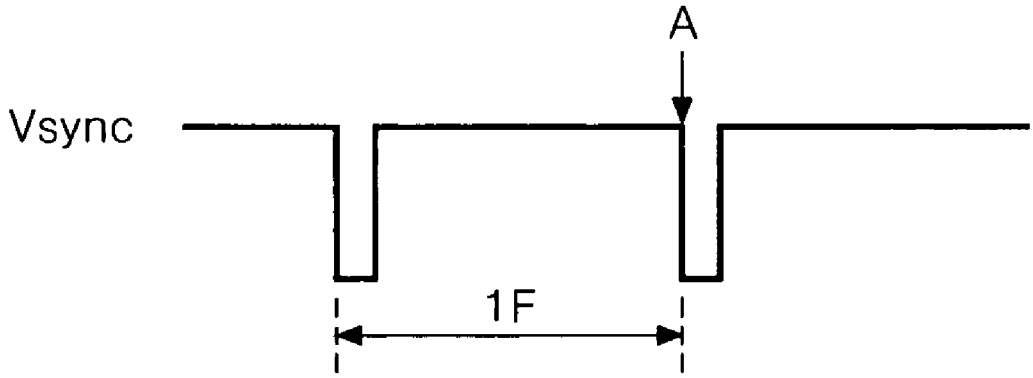
FIG. 4 is a waveform diagram of a vertical synchronizing signal applied to a ground voltage source controller shown in FIG. 3.

FIG. 3 is a block circuit diagram showing a configuration of a driving-apparatus for an organic EL display panel according to an embodiment of the present invention.

Referring to FIG. 3, the driving apparatus for the EL display panel includes a pixel matrix 40 having sub-pixels 54 arranged at each area defined by each intersection between gate lines GL and data lines DL, a gate driver 42 for driving the gate lines GL of the pixel matrix 40, a data driver 44 for driving the data lines DL of the pixel matrix 40, a power supply 46 and a ground voltage source GND connected to the pixel matrix 40, and a ground voltage source controller 52 for controlling a connection of the pixel matrix 40 with the ground voltage source GND.

The pixel matrix 40 includes R, G and B sub-pixels 54 provided for each area defined by each intersection between a plurality of gate lines GL and a plurality of data lines DL. Each pixel is implemented by a combination of the three R, G and B sub-pixels 54. If a scanning pulse is applied to the gate line GL, then each of the R, G and B sub-pixels 54 receive a data signal from the data line DL to generate a light corresponding to the data signal. To this end, each of the R, G and B sub-pixels 54 includes an EL cell OEL having a cathode connected to the ground voltage source GND, and a cell driver 56 connected to the gate line GL and the data line DL to control a current amount fed to an anode of the EL cell OEL from a power line PL, thereby driving the EL cell OEL.

More specifically, the cell driver 56 includes a switching thin film transistor T1 having a gate terminal connected to the gate line GL, a source terminal connected to the data line DL and a drain terminal connected to a node N1, a driving thin film transistor T2 having a gate terminal connected to the node N1, a source terminal connected to the power line PL and a drain terminal connected to the EL cell OEL, and a storage capacitor C connected between the power line PL and the node N1.

If the scanning pulse is applied to the gate line GL, then the switching thin film transistor T1 is turned on to thereby apply a data signal supplied to the data line DL, via the node N1, to the gate terminal of the driving thin film transistor T2. At this time, the storage capacitor C charges a difference voltage between a driving voltage VDD supplied, via the power line PL, from the power supply 46 and the data signal supplied to the node N1. The driving thin film transistor T2 controls a current amount I fed from the power line PL to the EL cell OEL in response to a voltage supplied to the node N1, thereby controlling a light-emitting amount of the EL cell OEL. Further, when the switching thin film transistor T1 is turned off, the driving thin film transistor T2 supplies a constant current I until a data signal at the next frame is applied by a voltage charged in the storage capacitor C, thereby keeping a light-emission of the EL cell OEL.

The gate driver 42 applies the scanning pulses to sequentially drive the gate lines GL.

The data driver 44 supplies R, G and B data signals RD, GD and BD to each data line DL whenever the scanning pulse is applied. At this time, the data driver 44 converts digital data inputted from a timing controller (not shown) into analog data signals. For instance, the data driver 44 voltage-divides a gamma reference voltage inputted from a gamma reference voltage generator (not shown) into a plurality of gamma voltage levels, and selects the gamma voltage level corresponding to the input digital data to apply it as an analog data signal.

The ground voltage source controller 52 opens the ground voltage source GND and the pixel matrix 40 until the power supply 46 is turned on and at least one frame of data is supplied, via the data driver 44, to the pixel matrix 40. Thus, a formation of a current path at the EL cell OEL caused by the initial driving voltage VDD prior to a writing of a data into the pixel matrix 40 can be shut off to prevent an initial blinking phenomenon.

More specifically, the ground voltage source controller 52 opens the ground voltage source GND and the cathode CE of the pixel matrix 40 until the power supply 46 is turned on and a data signal at the first frame is written into the pixel matrix 40 by utilizing a vertical synchronizing signal Vsync for dividing the data for each frame, and thereafter shorts the ground voltage source GND and the cathode CE of the pixel matrix 40, thereby forming a current path at the EL cell OEL under control of the cell driver 56.

To this end, the ground voltage source controller 52 includes a switching device, that is, an NMOS thin film transistor NT connected between the ground voltage source GND and the cathode CE of the pixel matrix 40, and a latch, that is, a D flip-flop 50 for controlling the NMOS thin film transistor NT.

The D flip-flop 50 receives a driving voltage supplied by a turn-on of the power supply 46 as an input signal D, and receives a vertical synchronizing signal Vsync as an enable signal GE in order to recognize the first frame. The vertical synchronizing signal Vsync is applied, via the data driver 44, from a timing controller (not shown) and then is inverted by an inverter INV to be thereby inputted as the enable signal GE. For instance, as shown in FIG. 4, the vertical synchronizing signal Vsync toggled from a high logic into a low logic at a starting time of each frame F is inputted, via the inverter INV, as the enable signal GE of the D flip-flop 50. Thus, the D flip-flop 50 detects a time point A at which the vertical synchronizing signal Vsync is toggled after the first frame was finished and outputs the driving voltage VCC supplied as the input signal D as an output signal Q, thereby turning on the NMOS thin film transistor NT having kept a turn-off state to short the ground voltage source GND and the cathode CE of the pixel matrix 40. Thus, the pixel matrix 40 can prevent a blinking phenomenon caused by a current path until the first frame was finished after the power source was turned on. Further, the output signal Q of the D flip-flop 50 remains at the driving voltage VCC supplied as the input signal D even though the vertical synchronizing signal Vsync is toggled for each frame with the lapse of time, so that the NMOS thin film transistor NT also keeps a turn-on state. Thus, the pixel matrix 40 is emitted in accordance with a data supplied via the data driver 44 to thereby display a picture.

As described above, according to the present invention, the ground voltage source and the pixel matrix is opened until a power source is turned on and the first frame is finished to shut off a current path of the EL cell, thereby preventing an initial blinking phenomenon.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving an electro-luminescence display panel having a plurality of electro-luminescent (EL) cells containing cathode electrodes, comprising the steps of:

simultaneously opening all of the cathode electrodes of the EL cells and a ground voltage source at a beginning of a first period and throughout the first period, which begins at the turn-on time of a power source to initiate writing a first frame of data and ends at an ending time of the writing of the first frame of data, to shut off a current path of the EL cells during the entire first period; and shorting the cathode electrodes of the EL cells and the ground voltage source during a second period, after the ending time of the writing of the first frame of data, to form the current path of the EL cells, wherein the beginning of the first period corresponds to a beginning of the initiated writing of the first frame of data, the entire first period corresponds to the entire first frame of data, the simultaneously opening of all of the cathode electrodes of the EL cells and the ground voltage source occurs only one time when the power source is turned on, and the shorting of the cathode electrodes and the ground voltage source during the second period is for frames of the data following after the first frame, without opening the cathode electrodes of the EL cells and the ground voltage source.

2. The method according to claim 1, further comprising the step of detecting said first period by utilizing a vertical synchronizing signal for dividing said data for each frame.

3. A driving apparatus for driving an electro-luminescence display panel having a plurality of electro-luminescence (EL) cells, comprising:

a pixel matrix having a plurality of sub-pixel each including an EL cell and a cell driver for controlling a current supplied to the EL cell in accordance with data;

a ground voltage source connected to cathode electrodes of the EL cells;

a power source connected to a power source line; and a ground voltage source controller for simultaneously opening all of the cathode electrodes and the ground voltage source at a beginning of a first period and throughout the first period, which begins at the turn-on time of a power source to initiate writing a first frame of data and ends at an ending time of the writing of the first frame of data, to shut off a current path of the EL cells during the entire first period, and for shorting the cathode electrodes and the ground voltage source during a second period, after the ending time of the writing of the first frame of data, to form the current path of the EL cells, wherein the beginning of the first period corresponds to a beginning of the initiated writing of the first frame of data, the entire first period corresponds to the entire first frame of data, the simultaneously opening of all of the cathode electrodes of the EL cells and the ground voltage source occurs only one time when the power source is turned on, and the shorting of the cathode electrodes and the ground voltage source during the second period is for frames of the data following after the first frame, without opening the cathode electrodes of the EL cells and the ground voltage source.

4. The driving apparatus according to claim 3, wherein the ground voltage source controller detects said first period by utilizing a vertical synchronizing signal for dividing said data for each frame.

5. The driving apparatus according to claim 3, wherein the ground voltage source controller comprises:

a switching device for switching a connection between the cathode electrodes of the EL cells and the ground voltage source; and a latch for controlling the switching device using said vertical synchronizing signal.

6. The driving apparatus according to claim 5, wherein the latch opens the switching device from the turn-on time of the power source until an ending time of the writing of the first frame of data and thereafter shorts the switching device.

7. A driving apparatus for driving an organic electro-luminescence display panel having a plurality of electro-luminescence (EL) cells, comprising:

a data driver;

a gate driver;

a power supply;

an organic electro-luminescent display (OELD);

a cell driver comprising:

a first switching thin film transistor having a first gate terminal connected to the gate driver by a gate line, a first source terminal connected to the data driver by a data line, and a first drain terminal connected to a node, a second driving thin film transistor having a second gate terminal connected to the node, a second source terminal connected to the power supply by a power line, and a second drain terminal connected to an input to the OELD, and a storage capacitor connected between the second source terminal and the node;

a ground voltage source controller comprising an NMOS thin film transistor; and a ground connected to an output of the OELD via the NMOS thin film transistor, a gate of the NMOS thin film transistor configured to receive a driving voltage in response to a vertical synchronizing signal output from the data driver, wherein the ground voltage source controller opens the output of an OELD cathode and the ground at a beginning of a first period and throughout the first period, which begins at the turn-on time of a power source to initiate writing a first frame of data and ends at an ending time of the writing of the first frame of data, to shut off a current path of the EL cells during the entire first period, and shorts the output of the OELD cathode and the ground during a second period after the ending time of the writing of the first frame of data, to form the current path of the EL cells, wherein the beginning of the first period corresponds to a beginning of the initiated writing of the first frame of data, the entire first period corresponds to the entire first frame of data, the simultaneously opening of all of cathode electrodes of the EL cells and the ground voltage source occurs only one time when the power source is turned on, and the shorting of the output of the OELD cathode and the ground during the second period is for frames of the data following after the first frame, without opening the OELD cathode electrodes of the EL cells and the ground voltage source.

* * * * *